US011373478B2

(12) United States Patent
Ikeda et al.

(10) Patent No.: US 11,373,478 B2
(45) Date of Patent: Jun. 28, 2022

(54) GAME MACHINE

(71) Applicant: OMRON Corporation, Kyoto (JP)

(72) Inventors: Takuma Ikeda, Aichi (JP); Hiroyuki Onitsuka, Gifu (JP); Takahiro Ono, Aichi (JP); Masaaki Sumi, Gifu (JP)

(73) Assignee: Omron Corporation, Kyoto (JP)

( * ) Notice: Subject to any disclaimer, the term of this patent is extended or adjusted under 35 U.S.C. 154(b) by 63 days.

(21) Appl. No.: 16/138,628

(22) Filed: Sep. 21, 2018

(65) Prior Publication Data

US 2019/0122493 A1 Apr. 25, 2019

(30) Foreign Application Priority Data

Oct. 12, 2017 (JP) ..... JP2017-198671

(51) Int. Cl.
*G07F 17/32* (2006.01)

(52) U.S. Cl.
CPC ..... *G07F 17/3244* (2013.01); *G07F 17/3204* (2013.01)

(58) Field of Classification Search
CPC ..... G07F 17/3244; G07F 17/3204
See application file for complete search history.

(56) References Cited

U.S. PATENT DOCUMENTS

2003/0162582 A1* 8/2003 Gordon ..... G07F 17/32 463/20
2011/0224002 A1* 9/2011 Burke ..... G07F 17/32 463/42
2013/0084938 A1* 4/2013 Nicely ..... G07F 17/3223 463/20
2014/0179429 A1 6/2014 Okazaki et al.
2016/0343202 A1* 11/2016 Fujisawa ..... G07F 17/3244
2018/0089947 A1* 3/2018 Mariscal ..... G07F 17/3209
2019/0096181 A1* 3/2019 Lyons ..... G07F 17/3241

FOREIGN PATENT DOCUMENTS

| | | | |
|---|---|---|---|
| JP | H07108080 | A | 4/1995 |
| JP | 2006320530 | A | 11/2006 |
| JP | 2007260068 | A | 10/2007 |
| JP | 2008284290 | A | 11/2008 |
| JP | 2013-009851 | A | 1/2013 |
| JP | 2018191739 | A | 12/2018 |
| WO | 84/03792 | A1 | 9/1984 |

OTHER PUBLICATIONS

Office Action issued in Japanese Application No. 2017-198671; dated Jan. 6, 2021 (12 pages).

* cited by examiner

*Primary Examiner* — Dmitry Suhol
*Assistant Examiner* — Jeffrey K Wong
(74) *Attorney, Agent, or Firm* — Osha Bergman Watanabe & Burton LLP

(57) ABSTRACT

A game machine that can discriminate between two states of an occupied state and an unoccupied state includes a credit function. The game machine includes the credit function configured to determine presence or absence of a credit and a timer part configured to measure a lapse of time, and transitions to the occupied state in which a game is determined to be interrupted or the unoccupied state in which the game machine is determined to be idle according to a determination of the presence or absence of the credit in the credit function when the timer part measures a lapse of a first time.

1 Claim, 19 Drawing Sheets

Before depression

After depression

GAME MACHINE

CROSS-REFERENCE TO RELATED APPLICATION

This application is based on Japanese Patent Application No. 2017-198671 filed with the Japan Patent Office on Oct. 12, 2017, the entire contents of which are incorporated herein by reference.

FIELD

The present invention relates to a game machine such as a pachinko-slot, a slot machine, and a gaming machine.

BACKGROUND

Conventionally, in a game machine, such as a pachinko-slot, a slot machine, and a gaming machine, which has a function such as a credit function, two states of a currently playing state and a non-playing state are determined, and a game machine casing performs presentation such as light and sound for the purpose of attraction effect when the game machine is in the non-playing state.

For example, a slot machine disclosed in Japanese Unexamined Patent Application Publication No. 2013-9851 is determined to be in the non-playing state when 30 seconds that are a predetermined time elapses without setting the number of bets since one game ends or when a predetermined period of time elapses without setting the new number of bets since the number of bets is set.

However, only the two states of the currently playing state and the non-playing state are discriminated in the conventional game machine. For this reason, when a seat of the game machine is empty, the determination that the player temporarily interrupts the game due to a break or the like cannot be made only by the determination of the two states.

As a result, the attraction presentation is performed even on the game machine of the player who temporarily interrupts the game due to the break or the like, namely, the game machine that is in the occupied but in the non-playing state. Therefore, there is a problem that another player erroneously regards the game machine that is in the occupied state but is in the non-playing state as being empty to play the game using the game machine.

SUMMARY

The present invention has been made in view of the above-described conventional problem, and an object of the present invention is to provide a game machine that can discriminate between two states of an occupied state and an unoccupied state.

According to a first aspect of the present invention, in order to solve the problem, a game machine having a credit function includes: a credit determination part configured to determine presence or absence of a credit; and a timer configured to measure a lapse of time. The game machine transitions to an occupied state in which a game is determined to be interrupted or an unoccupied state in which the game machine is determined to be idle according to a determination of the presence or absence of the credit in the credit determination part when the timer measures a lapse of a first time.

According to the above configuration, the game machine has the credit function, and the credit determination part configured to determine the presence or absence of the credit and the timer configured to measure the lapse of time are provided in the game machine. When the timer measures the lapse of the first time, the credit determination part determines the presence or absence of the credit. At this point, the presence of the credit means that the player uses the game machine, but it can be determined that only time elapses because the game is interrupted for some reason. On the other hand, in the case that the credit is absent when the timer measures the lapse of the first time, there is a high possibility that the game machine is in the unoccupied state in which nobody plays the game machine.

The credit determination part determines the presence or absence of the credit when the timer of the game machine measures the lapse of the first time, the game machine transitions to the occupied state in which the game is interrupted when the credit is determined to be present, and the game machine transitions to the unoccupied state in which the game machine is idle when the credit is determined to be absent.

As a result, the game machine, which can discriminate between the two states of the occupied state and the unoccupied state by determining the presence or absence of the credit when the timer measures the lapse of the first time, can be provided.

Preferably the game machine according to a second aspect of the present invention further includes a controller configured to control the game machine to perform an attraction presentation on a non-playing visitor when the game machine transitions to the unoccupied state.

Consequently, the game machine is idle in the unoccupied state, so that the attraction presentation for encouraging the non-playing visitor to play the game using the game machine can be performed. Paradoxically, the attraction presentation cannot be performed in the occupied state, namely, when the game is currently interrupted. Consequently, another person can be prevented from erroneously playing the game machine in which the game is currently interrupted.

In the game machine according to a third aspect of the present invention, preferably the controller controls the game machine to perform a presentation for encouraging a player to play the game when the game machine transitions to the occupied state.

The occupied state means the state in which the player interrupts the game. Consequently, an operation rate of the game machine can be enhanced by performing the presentation for encouraging the player to play the game.

Preferably the game machine according to a fourth aspect of the present invention further includes a directional speaker configured to emit sound of the presentation.

The directional speaker can emit the sound having the directivity. As a result, in the occupied state, the presentation sound for encouraging the game can be emitted as limited as possible to an area of the player who currently interrupts the game using the directional speaker. In the unoccupied state, the overlapping of the sounds of the game machines is avoided, and the attraction presentation can efficiently be performed on the non-playing visitors passing in front of the game machine.

Preferably the game machine according to a fifth aspect of the present invention further includes a vibration speaker configured to emit sound of the presentation.

The vibration speaker radially emits a contact sound of a metal plate from an operation switch unit. As a result, the sound is emitted from the operation switch unit in the occupied state using the vibration speaker, so that the presentation for encouraging the player who interrupts the game to play the game can be performed. In the unoccupied state, because the sound is radiated from the operation switch unit, the game machine that radiates the sound can be easily recognized, and the attraction presentation can efficiently be performed on the non-playing visitors.

An aspect of the present invention produces an effect of providing a game machine that can discriminate between two states of an occupied state and an unoccupied state.

DETAILED DESCRIPTION

Hereinafter, an embodiment (hereinafter also referred to as the embodiment) according to an aspect of the present invention will be described with reference to the drawings.

Application Example

Figure 1:
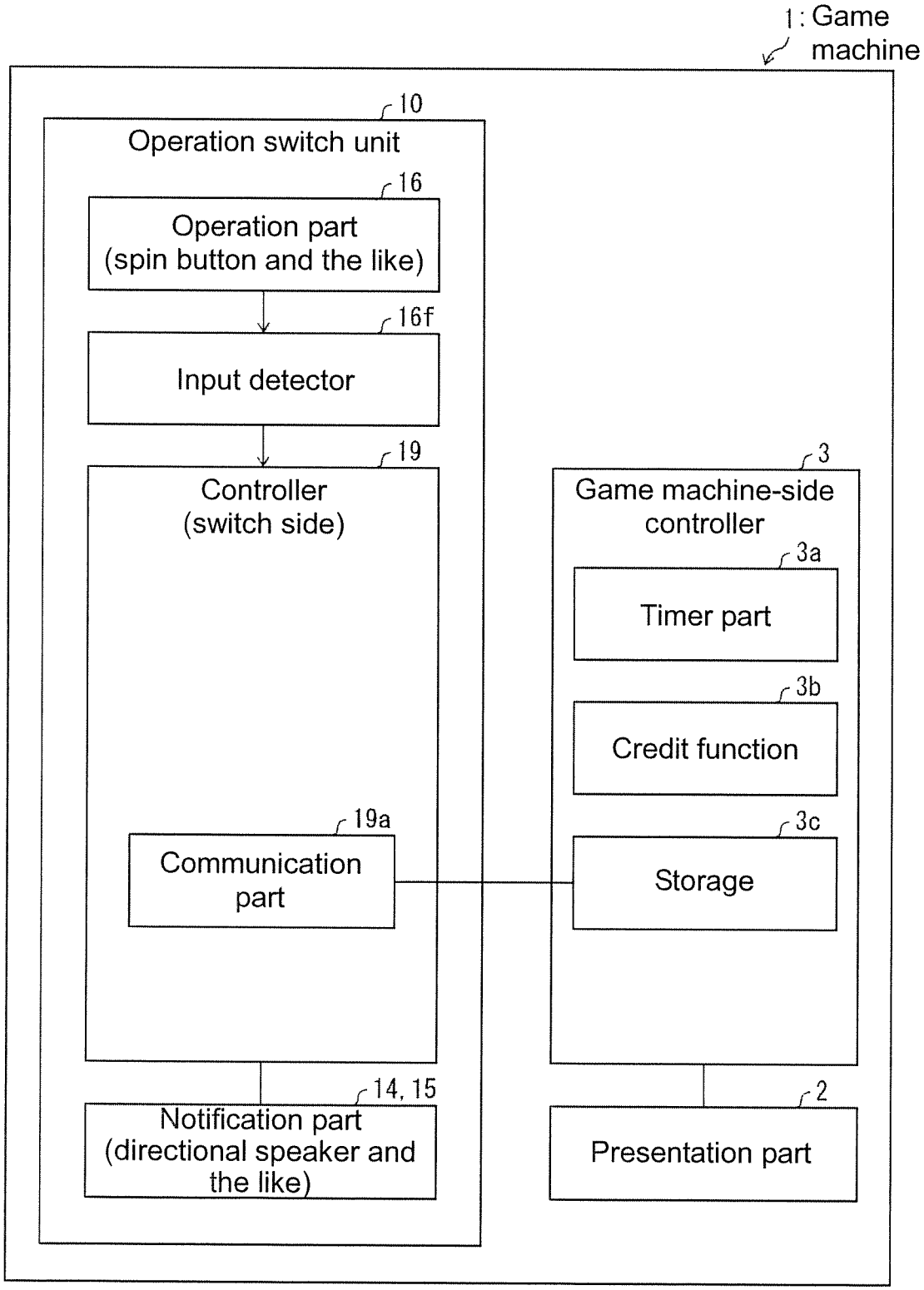
FIG. 1 is a block diagram illustrating a game machine according to a first embodiment of the present invention, and illustrating a configuration of a control mechanism of the game machine.

An example of a scene to which the present invention is applied will be described first with reference to FIG. 1. FIG. 1 is a block diagram illustrating a game machine 1 according to an aspect of the present invention, and illustrating a configuration of a control mechanism of the game machine 1.

As illustrated in FIG. 1, the game machine 1 of an aspect of the present invention includes a credit function 3*b* configured to determine presence or absence of a credit and a timer part 3*a* configured to measure a lapse of time, and transitions to an occupied state in which the game is determined to be interrupted or an unoccupied state in which the game machine is determined to be idle according to the determination of the presence or absence of the credit in the credit function 3*b* when the timer part 3*a* measures a lapse of a first time. The credit function 3*b* has a function as a credit determination part. The timer part 3*a* has a function as a timer.

According to the above configuration, the credit function 3*b* is caused to determine the presence or absence of the credit when the timer part 3*a* measures the lapse of the first time. At this point, the presence of the credit means that the player uses the game machine, but it can be determined that only time elapses because the game is interrupted for some reason. On the other hand, in the case that the credit is absent when the timer measures the lapse of the first time, there is a high possibility that the game machine is in the unoccupied state in which nobody plays the game machine.

For this reason, in determining the presence or absence of the credit by the credit function 3*b*, the game machine transitions to the occupied state in which the game is interrupted when the credit is determined to be present, and the game machine transitions to the unoccupied state in which the game machine is idle when the credit is determined to be absent.

As a result, the game machine, which can discriminate between the two states of the occupied state and the unoccupied state by determining the presence or absence of the credit when the timer measures the lapse of the first time, can be provided.

Configuration Example

An embodiment according to an aspect of the present invention will be exemplified with reference to FIGS. 1 to 16.

In the embodiment, a pachinko-slot will be described as an example of the game machine. However, in an aspect of the present invention, the game machine is not limited to the pachinko-slot. That is, an aspect of the present invention can be applied to any game machine as long as the game machine has the credit function. For example, an aspect of the present invention can be applied to game machines such as a slot machine other than a pachinko-slot, a pachinko, a gaming machine for casino, a card game machine such as a poker game, and a mahjong game machine.

For example, in the pachinko-slot, when a plurality of reels on which a plurality of kinds of symbols are displayed rotate and stops, a scoring combination is decided by alignment of the plurality of displayed symbols and the kind of the aligned symbols, and a prize is given to the player according to the decided scoring combination and the number of bets (bet number). Selling of the number of bets (bet number) and rotation of the reel are performed by pressing a button. That is, for example, 40 medals are inserted into the game machine as credits by the player in advance. Without inserting the medal every time, the player decides the number of bets (bet number) by manually pressing the bet button corresponding to the number of set bets (bet number). Then, the player manually presses the spin button that is a reel rotation start button so that the game machine automatically fixes a win lottery, and starts the rotation of the reel after the winning lottery is fixed, and the rotation of the reel is automatically stopped.

Figure 2A:
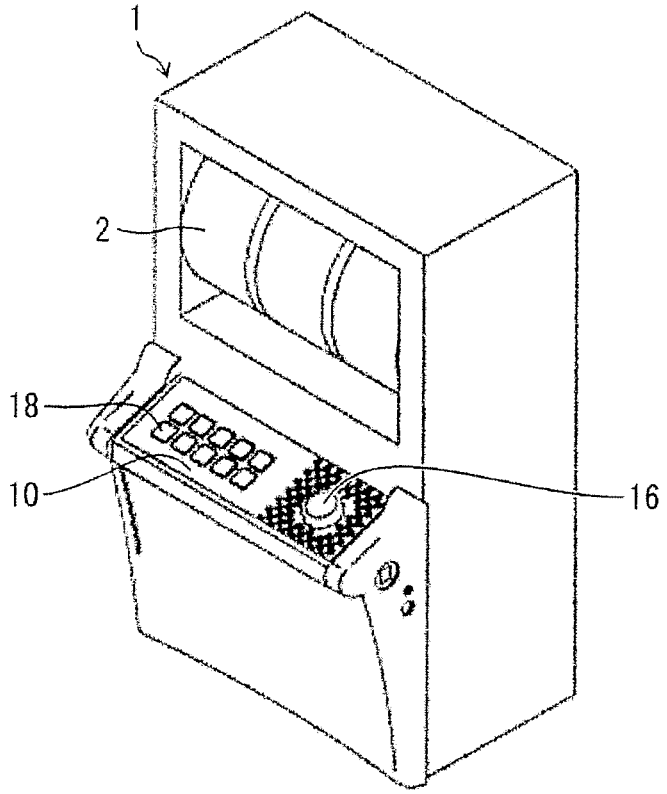
FIG. 2A is a perspective view illustrating a configuration of the game machine.
Figure 2B:
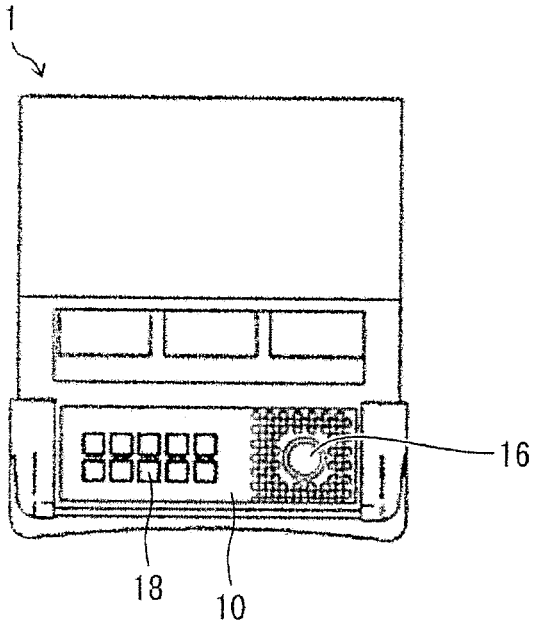
FIG. 2B is a plan view illustrating the configuration of the game machine.

The configurations of the game machine 1 and an operation switch unit 10 according to the embodiment will be described with reference to FIGS. 2A and 2B. FIG. 2A is a perspective view illustrating the configuration of the game machine 1 of the embodiment. FIG. 2B is a plan view illustrating the configuration of the game machine 1.

As illustrated in FIGS. 2A and 2B, in the game machine 1 of the embodiment, a display 2 is provided at a position corresponding to player's eyes in an upper portion of a game machine casing. The operation switch unit 10 is provided in a vicinity of a center of the game machine casing on which a hand of the player is placed such that an operation portion is slightly tilted toward a player side.

A plurality of reels on which a plurality of types of symbols are displayed are displayed on the display 2. The player pushes down a spin button 16 of the operation switch unit 10 to start the rotation of each reel, and the reel stops automatically under the control of a game machine-side controller 3 (to be described later) of the game machine 1. In the game machine 1, when the reel stops, the scoring combination is decided by alignment of the plurality of symbols displayed on the display 2 and the type of the aligned symbols, and the prize is given to the player according to the scoring combination and the number of bets (bet number). In the embodiment, each reel is displayed on the display screen such as a liquid crystal screen, but the reel is not necessarily limited to the display on the display screen. Alternatively, the reel may actually be provided.

Figure 3A:
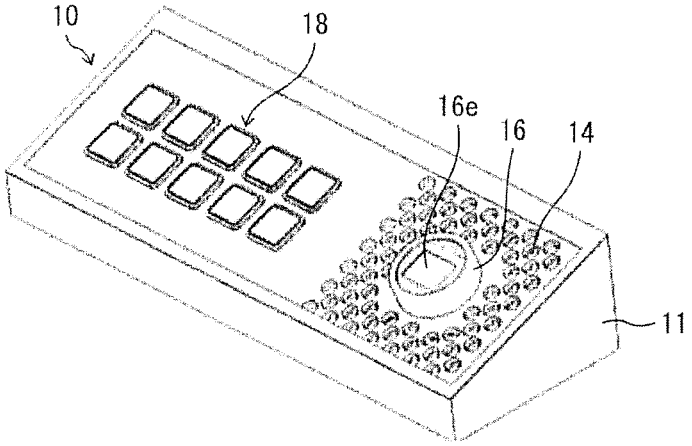
FIG. 3A is a perspective view illustrating a configuration of an operation switch unit included in the game machine when the operation switch unit is viewed from obliquely above.
Figure 3B:
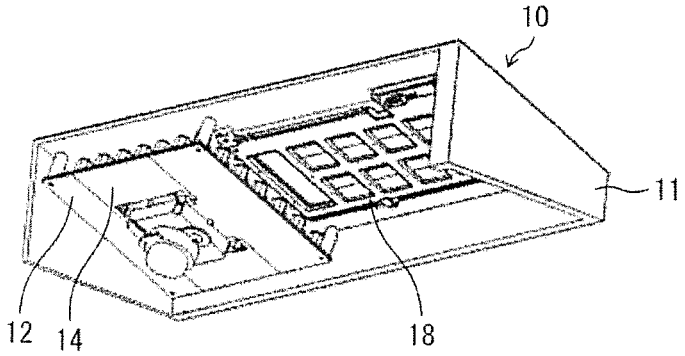
FIG. 3B is a perspective view illustrating the configuration of the operation switch unit when the operation switch unit is viewed from obliquely below.
Figure 3C:
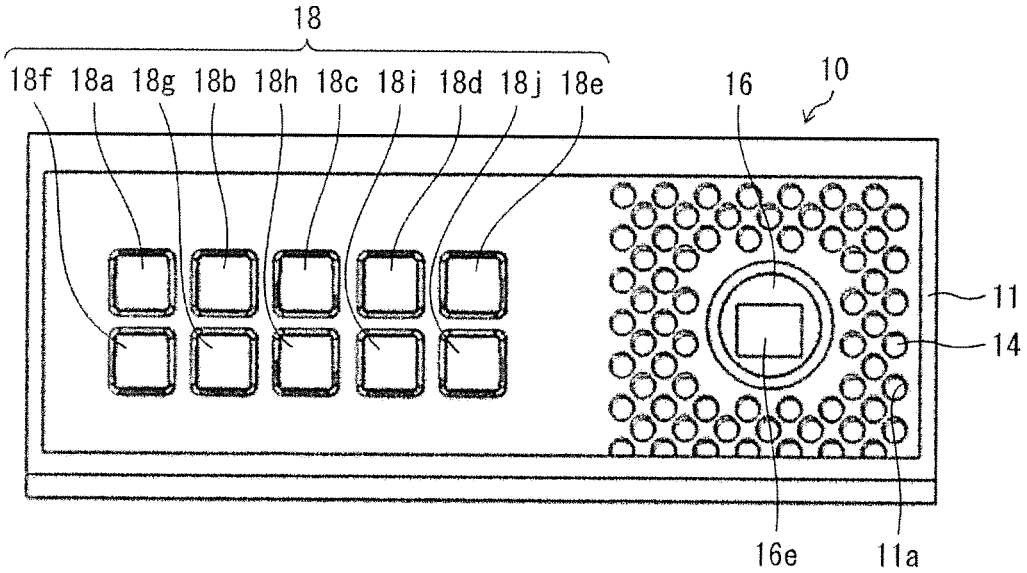
FIG. 3C is a plan view illustrating the configuration of the operation switch unit.

The configuration of the operation switch unit 10 provided in the game machine 1 will be described with reference to FIGS. 3A, 3B, and 3C. FIG. 3A is a perspective view illustrating the configuration of the operation switch unit 10 when the operation switch unit 10 is viewed from obliquely above. FIG. 3B is a perspective view illustrating the configuration of the operation switch unit 10 when the operation switch unit 10 is viewed from obliquely below. FIG. 3C is a plan view illustrating the configuration of the operation switch unit 10.

As illustrated in FIGS. 3A, 3B, and 3C, the operation switch unit 10 includes a switch unit casing 11, which can be separated from the game machine 1 and receives the operation from the player. Specifically, in the operation switch unit 10, for example, ten bet buttons 18 are provided as a notification method selecting part on a left side, and one spin button 16 is provided on a right side. Both the bet button 18 and the spin button 16 function as an operation part in an aspect of the present invention. In the operation switch unit 10, for example, the bet button 18 receives a setting operation of the number of bets (bet number) when the player plays the game machine 1. The spin button 16 receives the operation such as start of rotation of the reel.

In the embodiment, for example, ten bet buttons 18*a* to 18*j* are provided as the bet button 18. That is, for example, the bet button 18*a* is used to set the number of bets (bet number) to 1, the bet button 18*b* is used to set the number of bets (bet number) to 2, and the bet button 18*j* is used to set the number of bets (bet number) to 10. To set the number of bets (bet number) to 10 means that the number of bets (bet number) corresponding to the number of bets (bet number) for 10 medals is set by pressing the bet button 18*j*. However, the number of the bet buttons 18 is not limited to ten, but may be fewer or more than ten. Alternatively, the number of the bet buttons 18 may be one. For example, for one bet button 18, the bet button 18 is continuously pressed down three times when the number of bets (bet number) is set to 3. Consequently, the number of bets (bet number) for three medals can be set.

At this point, in the embodiment, each of the ten bet buttons 18 can set the number of bets (bet number) by the instantaneous one-time pressing down, and by pressing down the specific bet button 18 for a long time, types of a plurality of operation confirmation notification methods can be selected in order to confirm the operation input (to be described later).

Figure 4A:
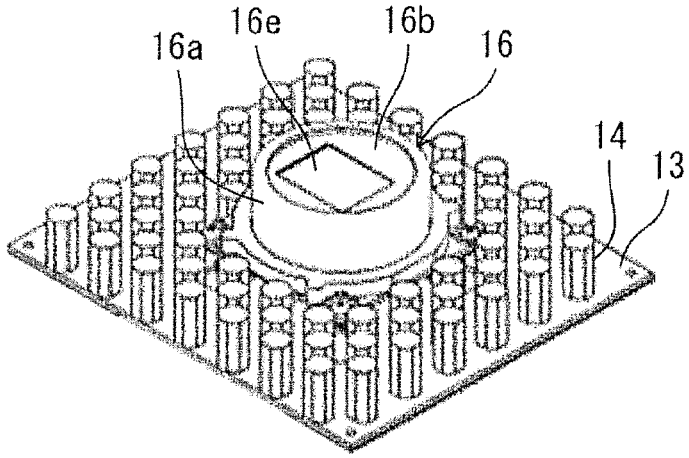
FIG. 4A is a perspective view illustrating a configuration of an operation part and a vibration speaker of the operation switch unit when the operation part and the vibration speaker are viewed from obliquely above.
Figure 4B:
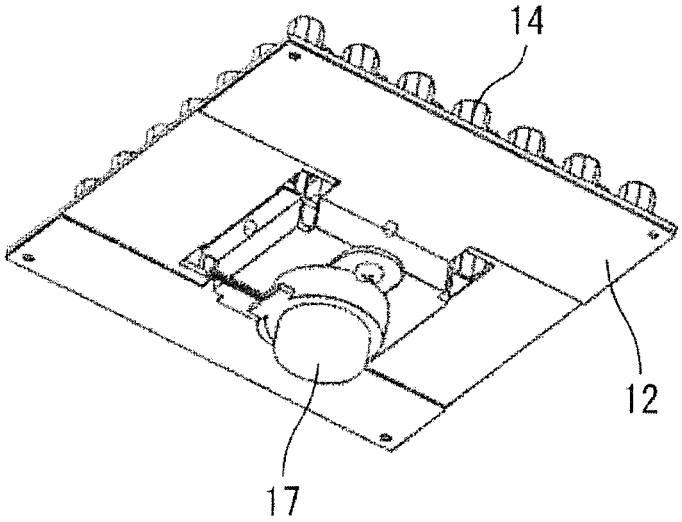
FIG. 4B is a perspective view illustrating the operation part and the vibration speaker of the operation switch unit when the operation part and the vibration speaker are viewed from obliquely below.
Figure 4C:
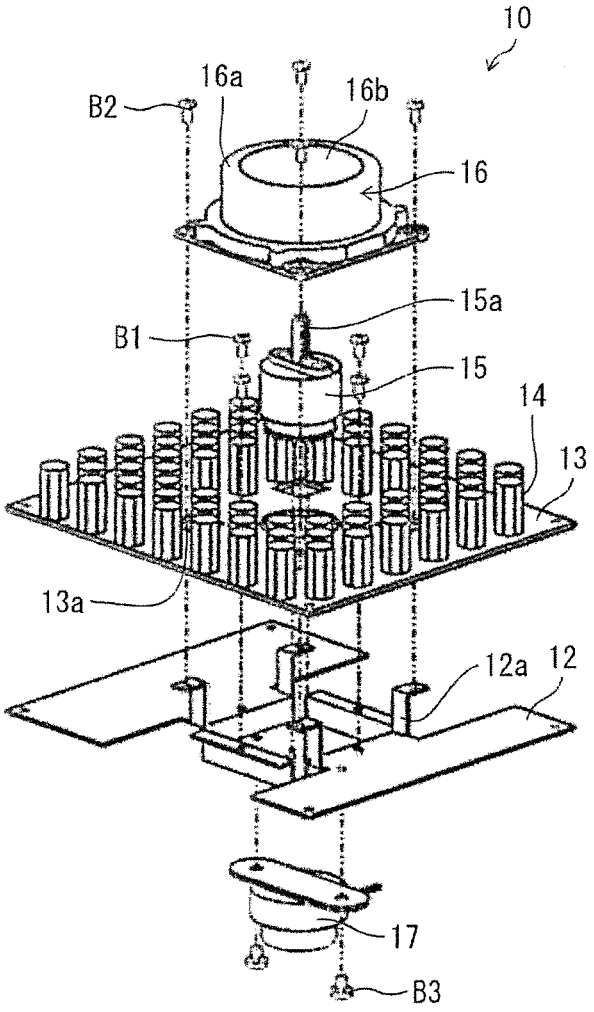
FIG. 4C is an exploded perspective view illustrating the configuration of the operation part and the vibration speaker of the operation switch unit when the operation part and the vibration speaker are viewed from obliquely above.
Figure 5A:
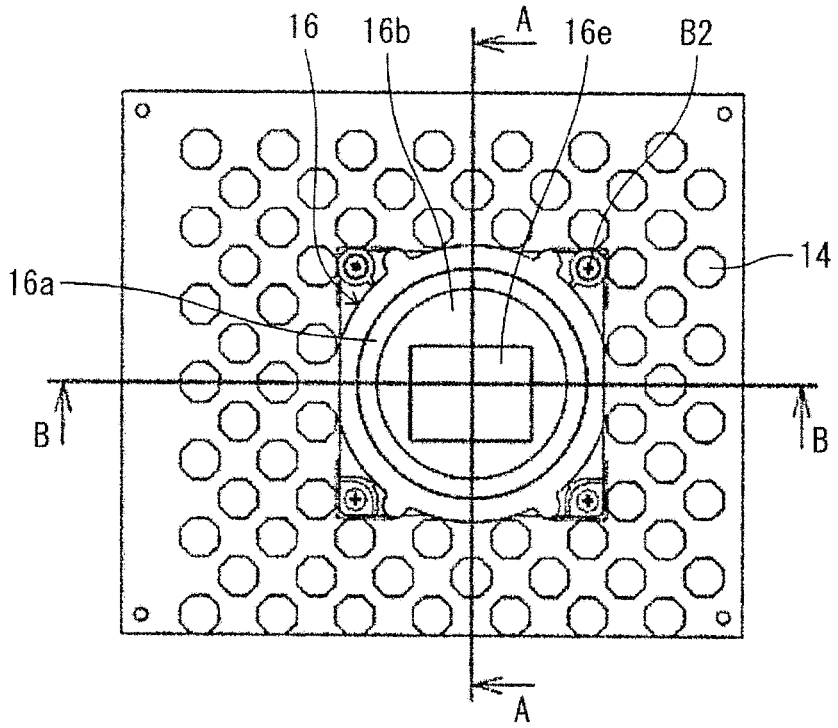
FIG. 5A is a plan view illustrating the configuration of the operation part and the vibration speaker of the operation switch unit.
Figure 5B:
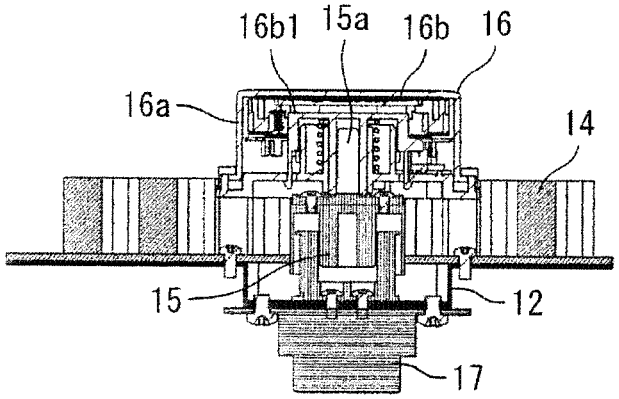
FIG. 5B is a front sectional view illustrating the configuration of the operation part and the vibration speaker of the operation switch unit.
Figure 5C:
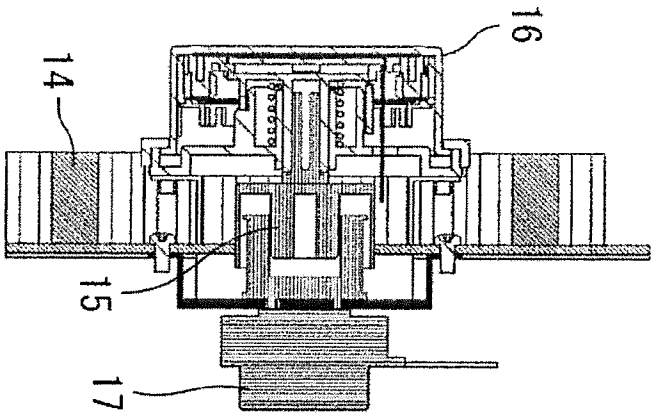
FIG. 5C is a side sectional view illustrating the configuration of the operation part and the vibration speaker of the operation switch unit.
Figure 6A:
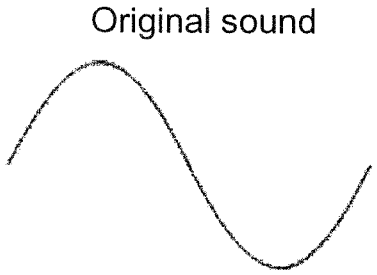
FIG. 6A is a waveform chart illustrating a waveform of an original sound of an operation confirmation sound.
Figure 6B:
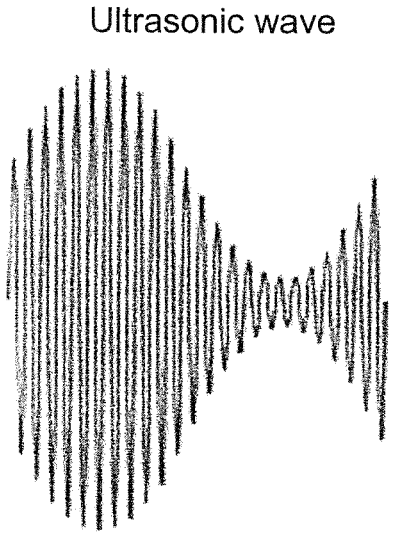
FIG. 6B is a waveform chart illustrating a waveform when an ultrasonic wave is superposed as a carrier wave on the original sound of the operation confirmation sound.
Figure 6C:
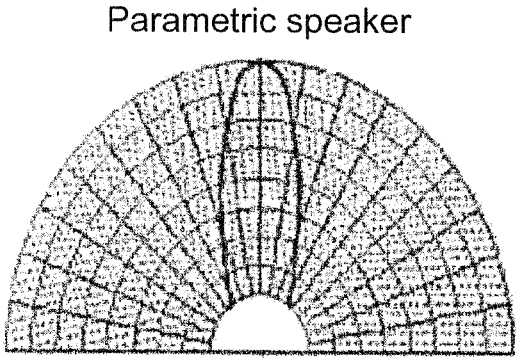
FIG. 6C is a view illustrating a spread when sound is emitted from a directional speaker.
Figure 6D:
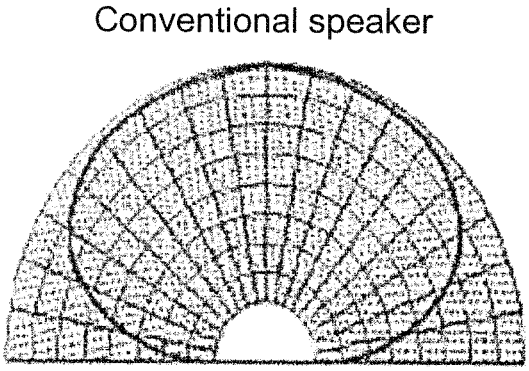
FIG. 6D is a diagram illustrating the spread when sound is emitted from a conventional speaker.

A configuration near the spin button 16 of the operation switch unit 10 of the embodiment will be described with reference to FIGS. 4A, 4B, 4C, 5A, 5B, 5C, 6A, 6B, 6C, and 6D. FIG. 4A is a perspective view illustrating the configurations of the spin button 16 and a directional speaker 14 of the operation switch unit 10 when the spin button 16 and the directional speaker 14 are viewed from obliquely above. FIG. 4B is a perspective view illustrating the configurations of the spin button 16 and the directional speaker 14 of the operation switch unit 10 when the spin button 16 and the directional speaker 14 are viewed from obliquely below. FIG. 4C is an exploded perspective view illustrating the configurations of the spin button 16 and the directional speaker 14 of the operation switch unit 10 when the spin button 16 and the directional speaker 14 are viewed from obliquely above. FIG. 5A is a plan view illustrating the configurations of the spin button 16 and directional speaker 14 of the operation switch unit 10. FIG. 5B is a front sectional view illustrating the configurations of the spin button 16 and directional speaker 14 of the operation switch unit 10. FIG. 5C is a side sectional view illustrating the configurations of the spin button 16 and directional speaker 14 of the operation switch unit 10. FIG. 6A is a waveform chart illustrating a waveform of an original sound of an operation confirmation sound. FIG. 6B is a waveform chart illustrating a waveform when an ultrasonic wave is superposed as a carrier wave on the original sound of the operation confirmation sound. FIG. 6C is a view illustrating a spread when sound is emitted from the directional speaker. FIG. 6D is a view illustrating the spread when the sound is emitted from a conventional speaker.

As illustrated in FIGS. 4A, 4B, 4C, 5A, 5B, and 5C, in the embodiment, a lower attaching base 12 including an upright member 12*a* rising from central four places, an upper attaching base 13 including a plurality of directional speakers 14 serving as a plurality of notification parts, the spin button 16, which has a bottomed cylindrical shape and is raised by the upright member 12*a* through four openings 13*a* of the upper attaching base 13 and fixed by a screw B2, and a voice coil motor 15 incorporated in the spin button 16 are provided in this order from a lower side as the configuration near the spin button 16 of the operation switch unit 10.

A vibration speaker 17 as the notification part is fixed onto a lower side of the lower attaching base 12 with a screw B3.

The directional speaker 14 is designed such that a leading end of the directional speaker 14 can be seen from a switch unit casing opening 11*a* formed in the switch unit casing 11 in FIG. 3C. A plurality of switch unit casing openings 11*a* are opened into a mesh shape around the spin button 16. The directional speaker 14 has directivity in the spread of the sound. In the embodiment, the directional speaker 14 is constructed with, for example, a parametric speaker in which a plurality of ultrasonic transducers are arranged. As used herein, the directivity is said to be directional when energy radiated by a wave source of a wave motion such as a radio wave and a sound wave, for example, an antenna or a speaker varies depending on a direction. The case that the energy is uniformly radiated in any direction is referred to as no directivity or omni-directional.

More specifically, when the original sound is constructed with a simple wave as illustrated in FIG. 6A, the original sound is radially diffused and transmitted as illustrated in FIG. 6D. On the other hand, in the directional speaker 14 of the embodiment constructed with the parametric speaker, the ultrasonic wave is used as the carrier wave for the original sound as illustrated in FIG. 6B, so that the sound spreads only at angles of several degrees as illustrated in FIG. 6C.

As a result, the sound emitted from the directional speaker 14 of the operation switch unit 10 of the embodiment generates the ultrasonic wave at angles of several degrees, and proceeds substantially linearly even after the generation. For this reason, the spread of the sound to the surroundings is extremely small. As a result, in the embodiment, the sound is only heard by the player who plays the game machine 1.

Thus, the directional speaker 14 of the embodiment has a function as an auditory sense notification section 1 of the operation confirmation auditory sense notification section for notifying the operator that the spin button 16 is operated by a directional sound.

The directional speaker 14 can make the ultrasonic wave towards the player. As a result, the operator can be notified of the operation input confirmation by the tactile sense by giving the vibration of the spin button 16 to the operator in handling the spin button 16. In this case, the directional speaker 14 has a function as a tactile sense notification section 1 of the operation confirmation tactile sense notification section.

In the embodiment, the directional speaker 14 is designed to perform the attraction presentation for encouraging the player and the non-playing visitor to play the game in the occupied state and the unoccupied state of the game machine 1. The presentation of the directional speaker 14 will be described later.

In the voice coil motor 15, as illustrated in FIGS. 5A, 5B, 5C, and 11A (to be described later), current is passed through a coil (not illustrated) to advance and retract an iron hammer 15*a* of the voice coil motor 15 toward and from a metal plate 16*b*1 provided on a bottom surface of a depression part 16*b* in the spin button 16. Consequently, the voice coil motor 15 thrusts up and pushes back the metal plate 16*b*1 of the depressed depression part 16*b*. As a result, the voice coil motor 15 gives the impact to the operator's hand when the depression part 16*b* of the spin button 16 is depressed, so that the voice coil motor 15 of the embodiment has a function as a tactile sense notification section 2 of the operation confirmation tactile sense notification section. In the voice coil motor 15, the depression part 16*b* of the spin button 16 can also be vibrated by increasing an advancing and retracting speed of the iron hammer 15*a*.

The vibration speaker 17 contacts with, for example, the lower attaching base 12 to generate a contact sound consisting of a metal sound such as clink. As a result, the vibration speaker 17 functions as an auditory sense notification section 2 of the operation confirmation auditory sense notification section for causing the operator to confirm that the depressing operation is performed by the contact sound when the depression part 16*b* of the spin button 16 is depressed.

In the embodiment, the vibration speaker 17 performs the presentation for encouraging the player and the non-playing visitor to play the game in the occupied state and the unoccupied state of the game machine 1. The presentation of the vibration speaker 17 will also be described later.

Figure 7A:
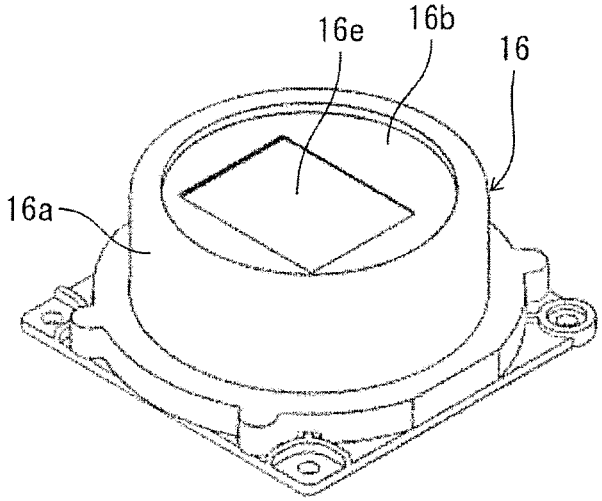
FIG. 7A is a perspective view illustrating the configuration of the operation part of the operation switch unit.
Figure 7B:
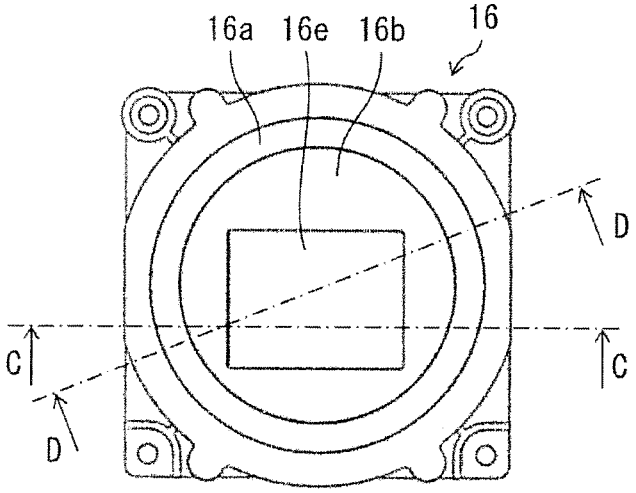
FIG. 7B is a plan view illustrating the configuration of the operation part of the operation switch unit.
Figure 8A:
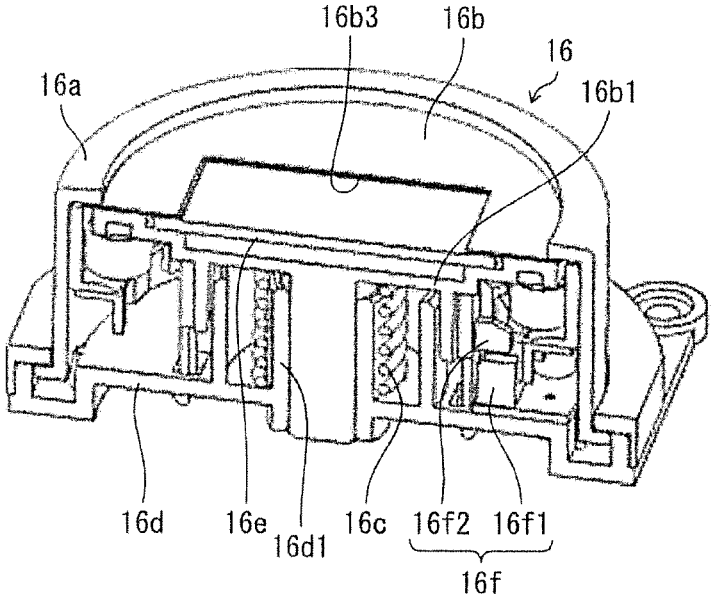
FIG. 8A is a perspective sectional view illustrating a section taken along line C-C in FIG. 7B, and illustrating the configuration of the operation part before depression.
Figure 8B:
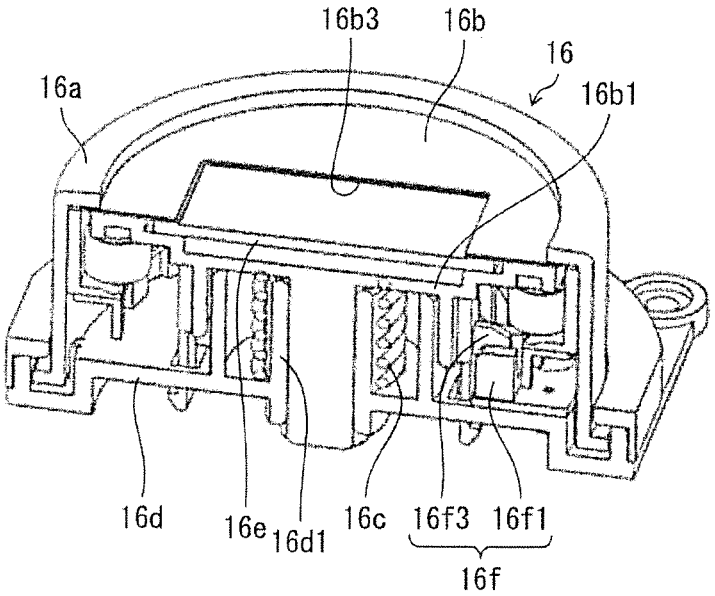
FIG. 8B is a perspective sectional view illustrating a section taken along line C-C in FIG. 7B, and illustrating the configuration of the operation part before the depression.
Figure 9:
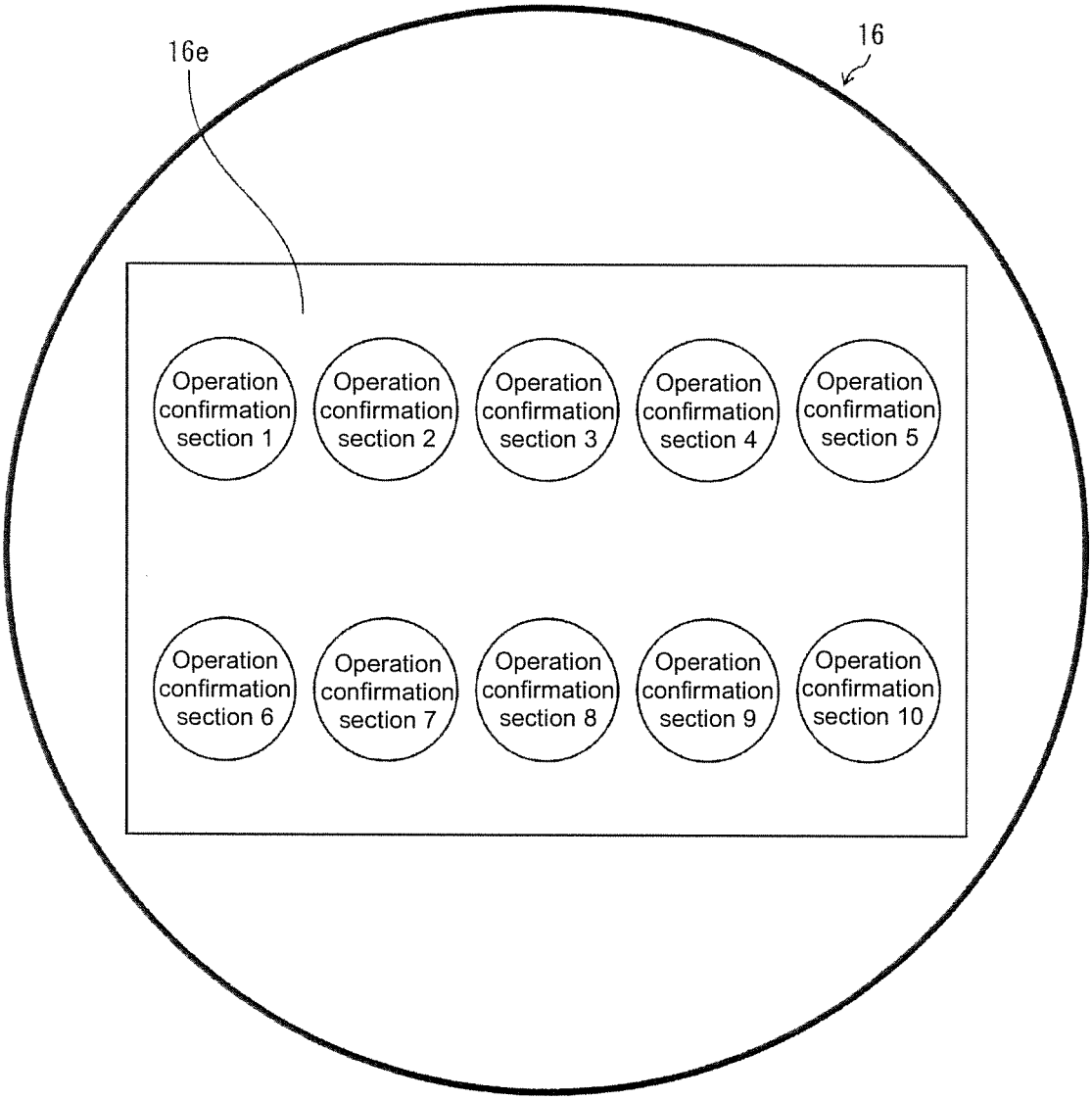
FIG. 9 is a plan view illustrating a display screen of options of operation confirmation section displayed on a liquid crystal display in the operation part of the operation switch unit.
Figure 10:
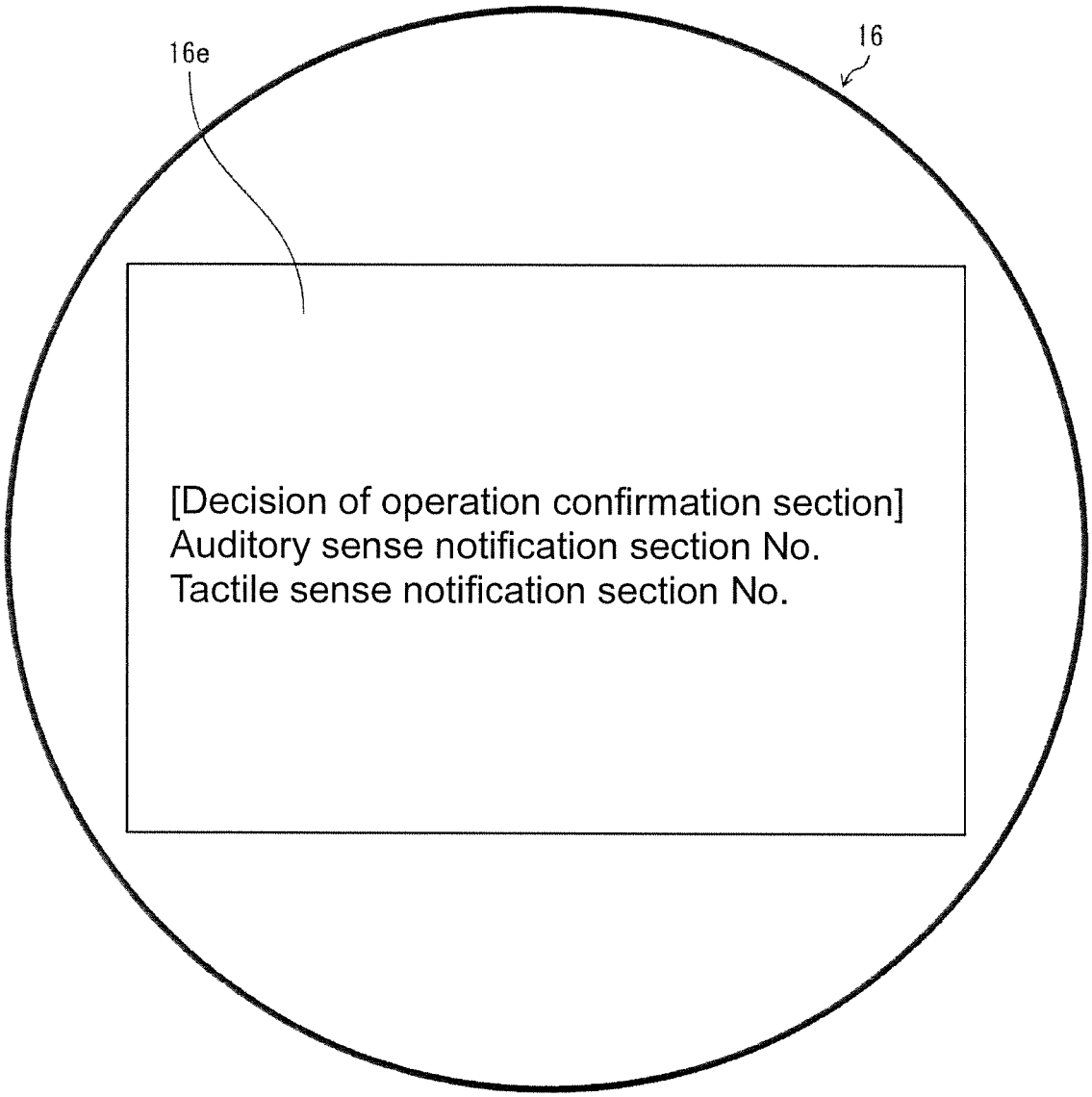
FIG. 10 is a plan view illustrating the display screen of selected operation confirmation section displayed on the liquid crystal display in the operation part of the operation switch unit.

The configuration of the spin button 16 will be described with reference to FIGS. 7A, 7B, 8A, 8B, 9, and 10. FIG. 7A is a perspective view illustrating the configuration of the operation part of the operation switch unit 10. FIG. 7B is a plan view illustrating the configuration of the spin button 16 of the operation switch unit 10. FIG. 8A a perspective sectional view illustrating a section taken along line C-C in FIG. 7B, and illustrating the configuration of the spin button 16 before the depression. FIG. 8B a perspective sectional view illustrating the section taken along line C-C in FIG. 7B, and illustrating the configuration of the spin button 16 after the depression. FIG. 9 is a plan view illustrating a display screen of options of operation confirmation section displayed on a liquid crystal display 16*e* in the spin button 16 of the operation switch unit 10. FIG. 10 is a plan view illustrating the display screen of the selected operation confirmation section displayed on the liquid crystal display 16*e* in the spin button 16 of the operation switch unit 10.

As illustrated in FIGS. 7A, 7B, 8A, and 8B, the spin button 16 includes a spin button casing 16*a* having a cylindrical shape, the depression part 16*b* that is advanced and retracted in a depression direction by the depression in the spin button 16, a coil spring 16*c* that upwardly biases the depression part 16*b*, and a lower support plate 16*d* that supports the coil spring 16*c* from the lower side.

Figure 11A:
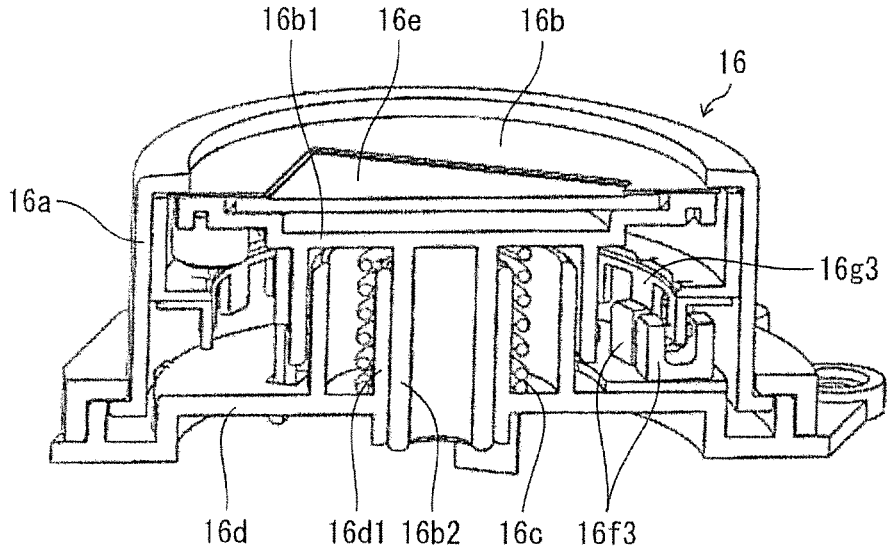
FIG. 11A is a perspective sectional view illustrating a section taken along line D-D in FIG. 7B, and illustrating a configuration of a detector of the operation part.

As illustrated in FIG. 11A (to be described later), the lower support plate 16*d* has an upright inner cylinder 16*d*1 rising at the center. A hanging cylinder 16*b*2 of the depression part 16*b* hangs down from the metal plate 16*b*1 inside the upright inner cylinder 16*d*1, and the iron hammer 15*a* of the voice coil motor 15 is loosely fitted inside the hanging cylinder 16*b*2. The coil spring 16*c* is wound around an outside of the upright inner cylinder 16*d*1.

There is a gap between a top surface of the upright inner cylinder 16*d*1 and a bottom surface of the metal plate 16*b*1 provided on the bottom surface of the depression part 16*b*. Consequently, the depression part 16*b* can be depressed by a constant depression distance, and the depression part 16*b* returns upward by biasing force of the coil spring 16*c* when depression force of the depression part 16*b* is released.

As illustrated in FIGS. 8A and 8B, a display opening 16*b*3 is provided in the depression part 16*b*, and the liquid crystal display 16*e* as a notification method display is exposed from the display opening 16*b*3. As illustrated in FIG. 9, the liquid crystal display 16*e* displays the operation confirmation sections respectively corresponding to the ten bet buttons 18*a* to 18*j* and, when one of the operation confirmation sections is selected, displays the selected operation confirmation section for a certain period of time as illustrated in FIG. 10.

Figure 11B:
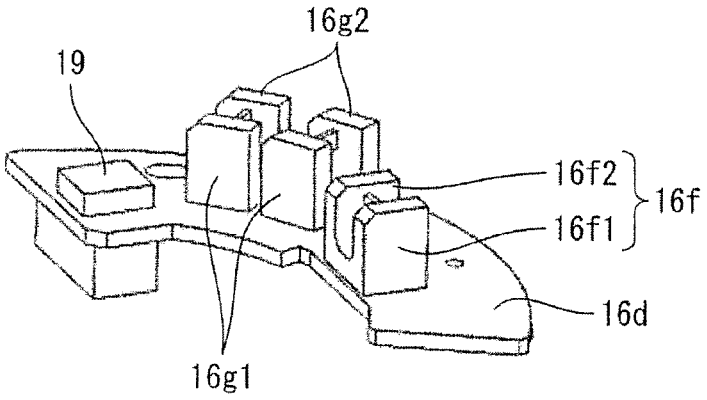
FIG. 11B is a main-part perspective view illustrating the detector that is extracted.

A mechanism that detects whether the depression part 16*b* is depressed in the spin button 16 of the embodiment will be described below with reference to FIGS. 11A and 11B. FIG. 11A is a perspective sectional view illustrating a section taken along line D-D in FIG. 7B, and illustrating a configuration of a detector of the spin button 16. FIG. 11B is a main-part perspective view illustrating the detector that is extracted.

As illustrated in FIGS. 8A, 8B, 11A, and 11B, the spin button 16 of the embodiment includes an input detector 16*f* that detects that the depression part 16*b* is depressed. The input detector 16*f* includes a light emitting part 16*f*1, a light receiving part 16*f*2, and a shielding plate 16*f*3. In the input detector 16*f*, the light receiving part 16*f*2 receives light emitted by the light emitting part 16*f*1. The shielding plate 16*f*3 inserted between the light emitting part 16*f*1 and the light receiving part 16*f*2 blocks the light from the light emitting part 16*f*1 according to the depression of the spin button 16. Consequently, the depression of the depression part 16*b* can be detected.

In the spin button 16 of the embodiment, the spin button casing 16*a* is rotatable with respect to the lower support plate 16*d*. The spin button 16 of the embodiment includes an input detector 16*g* that detects the rotation of the spin button casing 16*a*. The input detector 16*g* includes two sets of light receiving parts 16*g*2 that receive light emitted from two sets of light emitting parts 16*g*1 and a set of shielding plates 16*g*3 inserted between each light emitting part 16*g*1 and each light receiving part 16*g*2 according to the rotation of the spin button 16. In the input detector 16*g*, the light from the light emitting part 16*g*1 is blocked by the shielding plate 16*g*3 in either of the two sets of the light emitting parts 16*g*1 and the two sets of light receiving parts 16*g*2, thereby detecting whether the depression part 16*b* rotates. Left rotation or right rotation can be detected as the detection of the rotation.

As illustrated in FIG. 11B, a controller 19 of the embodiment is attached and fixed to the lower support plate 16*d* of the spin button 16. The controller 19 is constructed with a CPU.

The game machine 1 of the embodiment determines whether the game machine 1 is in the occupied state or the unoccupied state. The configuration of the control mechanism related to the determination of the occupied state or the unoccupied state in the game machine 1 of the embodiment will be described with reference to FIG. 1. FIG. 1 is a block diagram illustrating the configuration of the control mechanism in the game machine 1 of the embodiment.

As illustrated in FIG. 1, in the game machine 1 of the embodiment, the game machine casing includes a presentation part and the game machine-side controller 3, and the operation switch unit 10 includes the spin button 16 and the bet button 18 that are the operation part, the input detectors 16*f*, 16*g*, and the controller 19.

The presentation part of the game machine 1 is constructed with the display 2. The presentation part performs the presentation such as the rotation and stop of the reel of the display 2 during the game, and performs the attraction presentation when the game machine 1 is in the unoccupied state. The game machine-side controller 3 controls the presentation part of the game machine 1.

The game machine-side controller 3 of the game machine 1 includes the timer part 3*a* as the timer, the credit function 3*b*, and a storage 3*c*.

The timer part 3*a* measures the lapse of time. When the timer part 3*a* measures the lapse of a first time T1, the game machine-side controller 3 causes the credit function 3*b* to determine the presence or absence of the credit. The credit function 3*b* counts the number of inserted medals when the medals are inserted, and subtracts the number of medals of the number of bets (bet number) in each game, and adds the number of medals as the obtained prize. Consequently, the credit function 3*b* grasps the current number of medals. In the embodiment, the credit is determined to be present when the current number of medals is at least one.

The game machine 1 is determined to be in the occupied state when the credit is determined to be present. The game machine 1 is determined to be in the unoccupied state when the credit function 3*b* determines that the credit is absent.

A determination result of the presence or absence of the credit and a determination result of the occupied state or the unoccupied state are stored in the storage 3*c*, and sent to the controller 19 using a communication part 19*a*.

In the operation switch unit 10, an operation such as game start is performed using the spin button 16 as the operation part. When the spin button 16 is depressed down or rotated, the input detectors 16*f*, 16*g* detect the depression or the rotation of the spin button 16.

The controller 19 includes the communication part 19*a*. In response to an input signal from the spin button 16 and input detection signals from the input detectors 16*f*, 16*g*, the controller 19 transmits a notification that the input signal and the input detection signal are input to the game machine-side controller 3 via the communication part 19*a*.

When receiving the signals of the determination result of the presence or absence of the credit and the determination result of the occupied state or the unoccupied state from the game machine-side controller 3, the communication part 19*a* transmits a notification that the signals of the determination result of the presence or absence of the credit and the determination result of the occupied state or the unoccupied state are received to a notification part.

In the embodiment, the notification part is constructed with the directional speaker 14 and the vibration speaker 17. As described above, the directional speaker 14 has the function as the auditory sense notification section 1 of the operation confirmation auditory sense notification section for notifying the operator that the spin button 16 is operated by the ultrasonic wave. As described above, the vibration speaker 17 functions as the auditory sense notification section 2 of the operation confirmation auditory sense notification section for causing the operator to confirm that the depressing operation is performed by the contact sound when the depression part 16*b* of the spin button 16 is depressed. In the embodiment, the directional speaker 14 and the vibration speaker 17 are used to confirm the operation in the game state, to encourage the player to play the game in the occupied state, and to perform the attraction presentation effect for encouraging the non-playing visitor to play the game at the game machine 1 in the unoccupied state. In an aspect of the present invention, the notification part that performs the presentation is not necessarily limited to the directional speaker 14 and the vibration speaker 17, but may be one that performs the presentation using another presentation section. In the embodiment, the directional speaker 14 and the vibration speaker 17 are provided in the operation switch unit 10. However, in an aspect of the present invention, the directional speaker 14 and the vibration speaker 17 do not need to be provided in the operation switch unit 10, and may be provided in, for example, the game machine casing.

In the embodiment, the state of the game machine 1 is roughly divided into the game state, the occupied state, and the unoccupied state.

The game state is a state in which the player currently plays a game, specifically, a state in which a period from the end of a game to the start of the next game is shorter than the first time T1 in the state in which the credit is present. In the embodiment, in the game state, at least one of the notification part of the operation switch unit 10 and the presentation part of the game machine casing performs the presentation for the player with respect to the period from the end of a game to the start of the next game.

The occupied state is a state in which the game is determined to be interrupted because the period from the end of a game to the start of the next game is greater than or equal to the first time T1. In the embodiment, in the occupied state, based on the determination that the game is interrupted, at least one of the notification part of the operation switch unit 10 and a notification part (not illustrated) provided in the game machine casing performs the presentation for encouraging the player who interrupts the game to quickly play the game.

The unoccupied state is a state in which the game machine 1 is determined to be idle because the period from the end of a game to the start of the next game is greater than or equal to the first time T1 and because the credit is determined to be absent. In the embodiment, in the unoccupied state, at least one of the notification part of the operation switch unit 10 and the notification part (not illustrated) provided in the game machine casing performs the attraction presentation for encouraging the non-playing visitors around the game machine 1 to play the game in the game machine 1.

Figure 12:
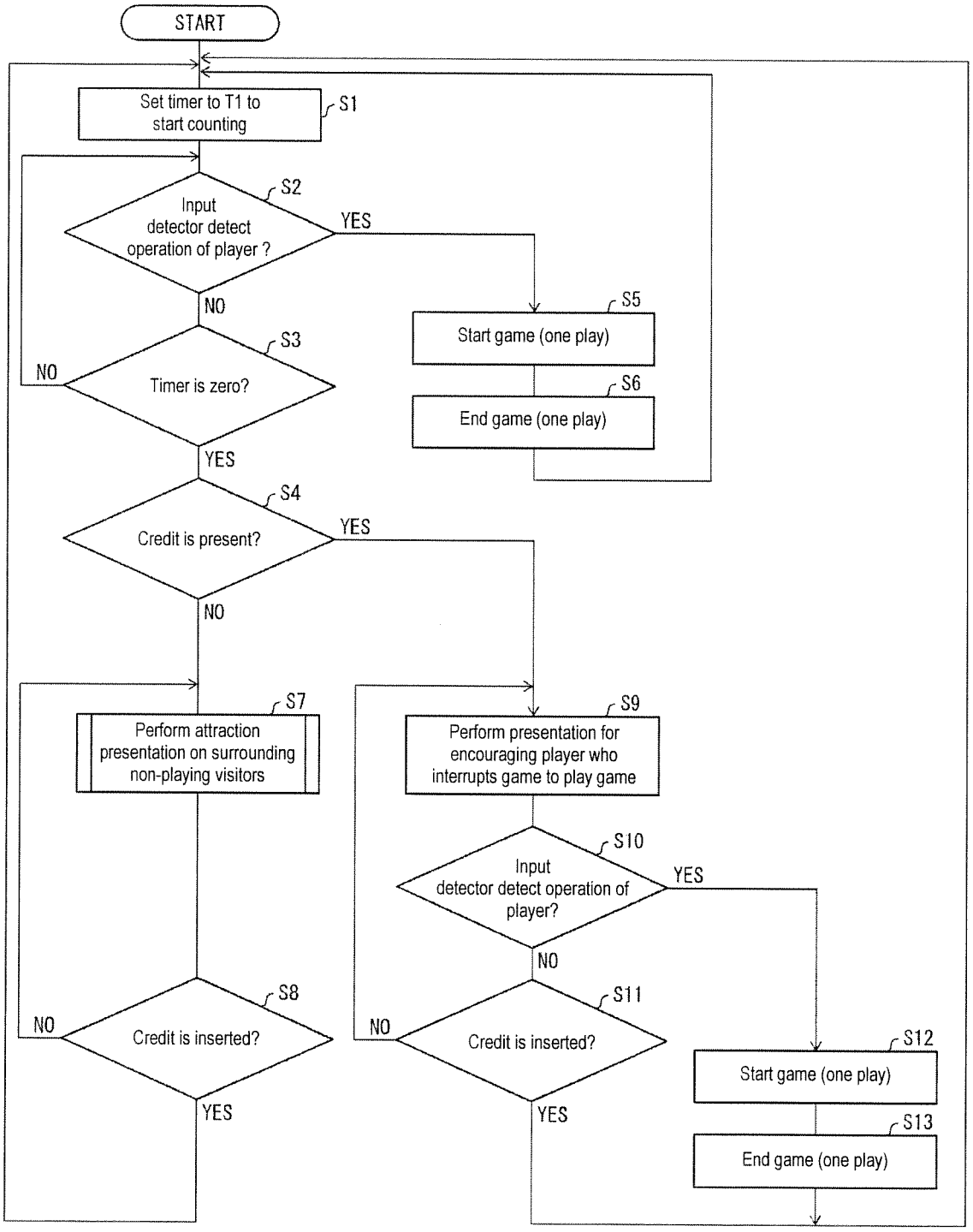
FIG. 12 is a flowchart illustrating a control action based on an occupied state and an unoccupied state by the operation switch unit and the control mechanism of the game machine.

The control action based on the occupied state and the unoccupied state by the operation switch unit 10 and the control mechanism of the game machine 1 will be described below with reference to FIG. 12. FIG. 12 is a flowchart illustrating the control action based on the occupied state and the unoccupied state by the operation switch unit 10 and the control mechanism of and the game machine 1.

As illustrated in FIG. 12, the timer of the timer part 3*a* is set to the first time T1 to start counting (S1). For example, the first time T1 is 180 seconds.

Whether the input detector 16*f* detects the operation of the player is determined (S2). When the determination that the input detector 16*f* detects the operation of the player is made in S2, the game of one play is started (S5), and the game of one play is ended (S6). When the game of one play is ended, the processing returns to S1 to restart the timer of the timer part 3*a*.

When the determination that the input detector 16*f* does not detect the operation of the player is made in S2, whether the remaining time of the timer part 3*a* is zero second is determined (S3). When the remaining time of the timer part 3*a* is not zero second, the processing returns to S2 to determine whether the input detector 16*f* detects the operation of the player.

When the determination that the remaining time of the timer part 3*a* is zero second is made in S3, whether the credit is present or absent is determined (S4).

When the determination that the credit is absent is made in S4, the game machine 1 transitions to the unoccupied state to perform the attraction presentation on the surrounding players (S7). That is, the game machine 1 is in the unoccupied state, and the presentation that the game machine 1 is usable is performed.

In this point, the credit function 3*b* determines whether the credit is inserted (S8). When the credit is not inserted, the processing returns to S7 to continue the attraction presentation on the surrounding players.

When the determination that the credit is inserted is made in S8, the processing returns to S1 to repeat the processing described above.

On the other hand, when the determination that the credit is present is made in S4, the game machine 1 transitions to the occupied state. That is, the period from the end of a game to the start of the next game in the state in which the credit is present is greater than or equal to the first time T1, whereby the game machine-side controller 3 determines that the current state is the state in which the player interrupts the game to take a break. The game machine-side controller 3 performs the presentation for encouraging the player who interrupts the game to play the game (S9).

Whether the input detector 16*f* detects the operation of the player is determined (S10). When the determination that the operation of the player is not detected is made in S10, whether the credit is inserted is determined (S11). When the credit is inserted, the processing returns to S1.

When the determination that the credit is not inserted is made in S11, the processing returns to S9 to perform the presentation for encouraging the player who interrupts the game to play the game.

On the other hand, when the determination that the operation of the player is detected is made in S10, the game machine-side controller 3 switches to the game state. Then, the game of one play is started (S12), and the game of one play is ended (S13). When the game of one play is ended, the processing returns to S1 to reset the timer of the timer part 3*a*.

Figure 13:
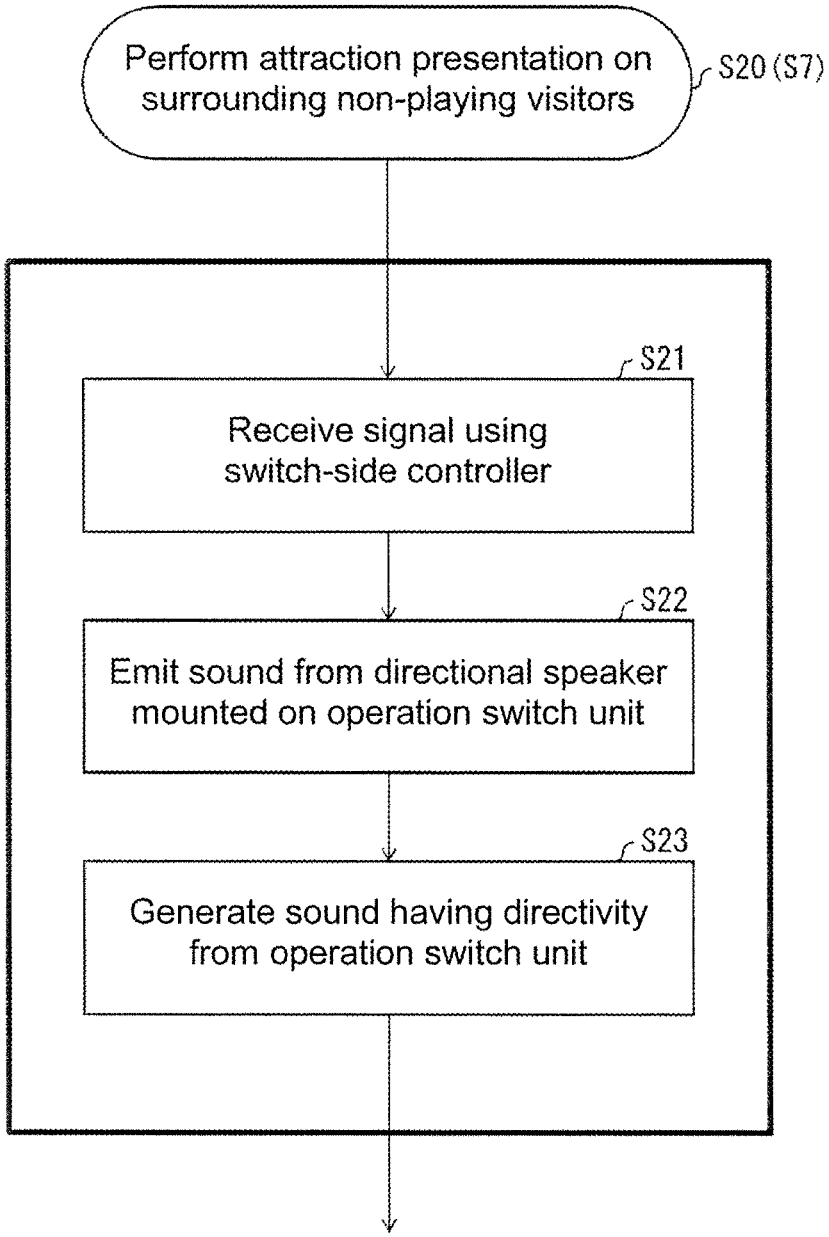
FIG. 13 is a flowchart of a subroutine illustrating the control action to perform an attraction presentation for encouraging surrounding non-playing visitors to play a game using the directional speaker in the unoccupied state.

In the embodiment, the directional speaker 14 and the vibration speaker 17 are provided in the operation switch unit 10. For this reason, in the routine for performing the attraction presentation on the surrounding players in S7 of FIG. 12, the presentation can be performed using the directional speaker 14 and the vibration speaker 17. A presentation method using the directional speaker 14 will be described with reference to FIG. 13. FIG. 13 is a flowchart of a subroutine illustrating the presentation method using the directional speaker 14.

As for the presentation method using the directional speaker 14, as illustrated in FIG. 13, when the controller 19 receives a signal indicating that the game machine 1 is in the unoccupied state from the game machine-side controller 3 (S21), the controller 19 causes the directional speaker 14 mounted on the operation switch unit 10 to emit sound having directivity (S22). Consequently, the directional speaker 14 emits the sound having the directivity. For this reason, the player who is looking for the favorite game machine 1 may notice the game machine 1 in which the directional speaker 14 generates the sound having the directivity, and play the game machine 1.

On the other hand, the player who currently plays the game machine next to the game machine 1 does not hear the presentation sound for the attraction presentation, so that the noise is not generated.

Figure 14:
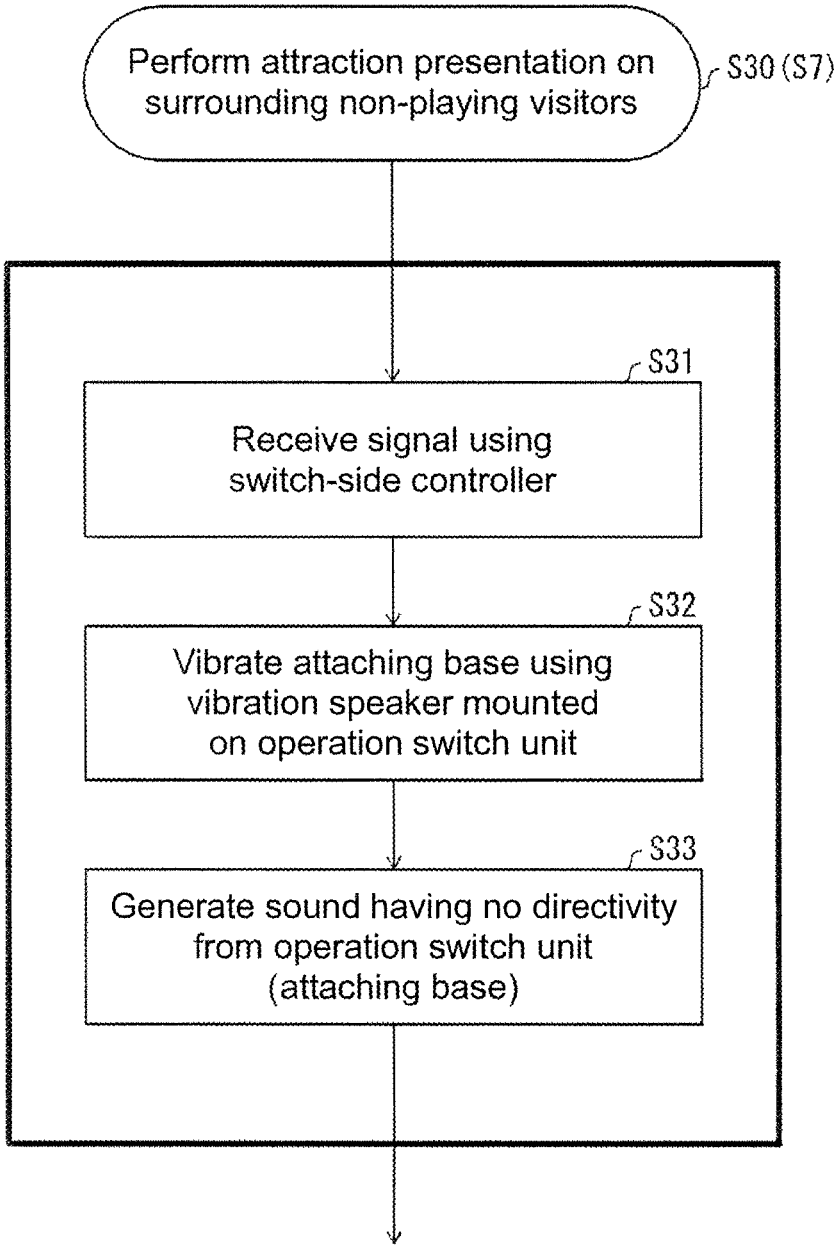
FIG. 14 is a flowchart of a subroutine illustrating the control action to perform the attraction presentation for encouraging surrounding non-playing visitors to play the game using the vibration speaker in the unoccupied state.

A presentation method using the vibration speaker 17 will be described with reference to FIG. 14. FIG. 14 is a flowchart of a subroutine illustrating the presentation method using the vibration speaker 17.

As for the presentation method using the vibration speaker 17, as illustrated in FIG. 14, when the controller 19 receives the signal indicating that the game machine 1 is in the unoccupied state from the game machine-side controller 3 (S31), the controller 19 causes the vibration speaker 17 mounted on the operation switch unit 10 to emit a contact sound of the lower support plate 16*d* (S32). Consequently, the vibration speaker 17 emits the sound (S33). The sound generated from the vibration speaker 17 is sound having no directivity. Due to the generation of the sound from the vibration speaker 17, the player who is looking for the favorite game machine 1 may notice the game machine 1 in which the vibration speaker 17 generates the sound, and play the game machine 1.

Figure 15A:
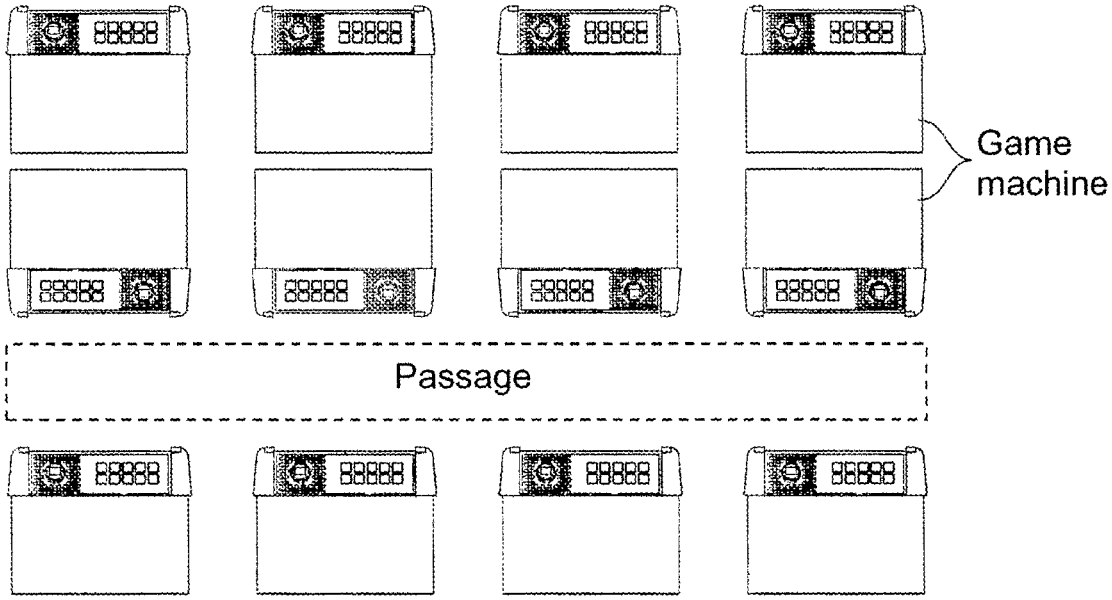
FIG. 15A is a plan view illustrating an attraction effect based on a determination of the occupied or unoccupied state of a game machine, and illustrating an arrangement state of game machines arranged in a game shop.
Figure 15B:
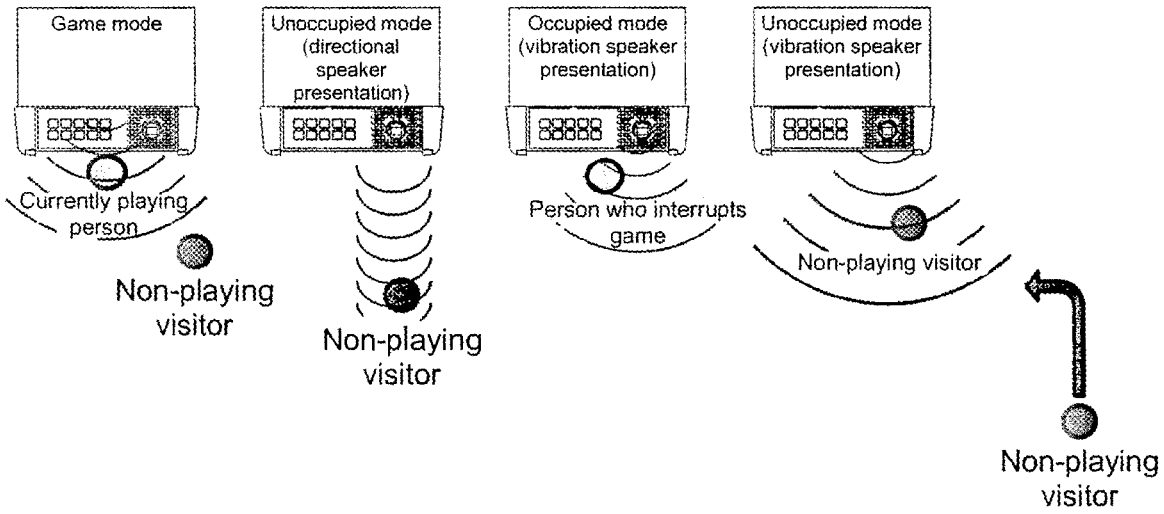
FIG. 15B is a plan view illustrating a manner of hearing the presentation when the game machine arranged in the game shop is in a currently gaming state, the occupied state, and the unoccupied state.
Figure 16A:
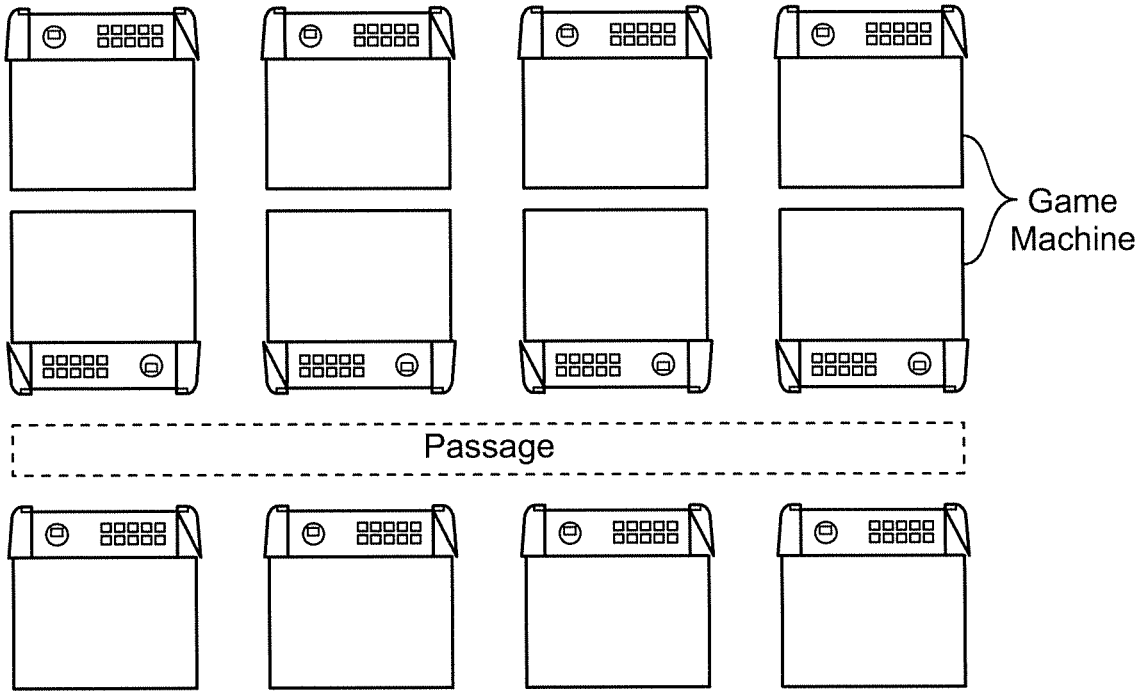
FIG. 16A is a plan view illustrating the attraction effect based on a conventional determination of the occupied or unoccupied state of the game machine, and illustrating the arrangement state of game machines arranged in the game shop.
Figure 16B:
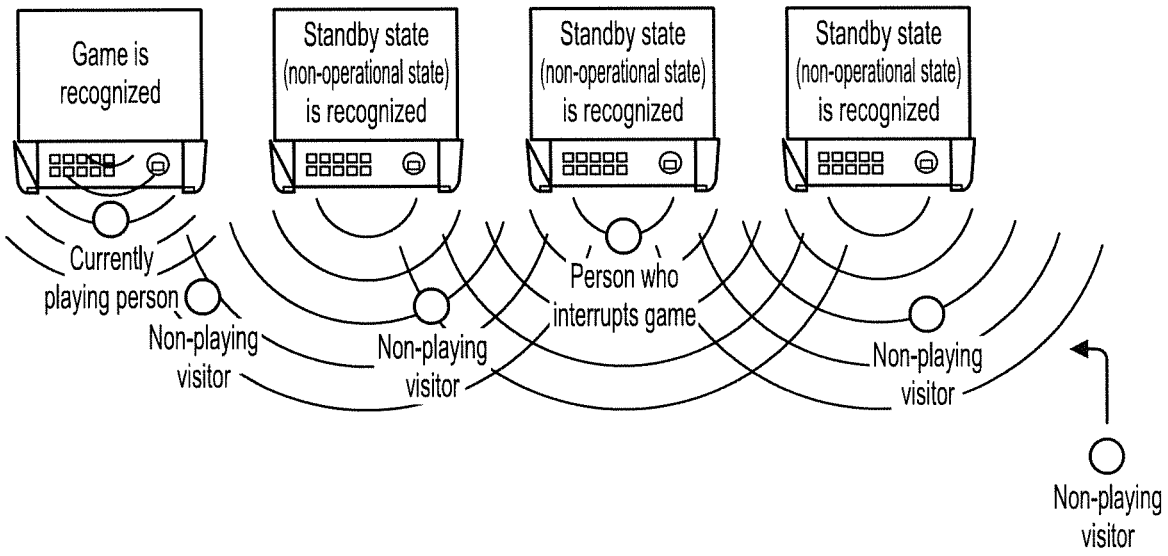
FIG. 16B is a plan view illustrating the manner of hearing the presentation when the game machine arranged in the game shop is in the currently gaming state or a standby state.

The attraction effect based on the determination of the occupied state and the unoccupied state of the game machine 1 will be described below with reference to FIGS. 15A, 15B, 16A, and 16B. FIG. 15A is a plan view illustrating an arrangement state of the game machines 1 arranged in the game shop. FIG. 15B is a plan view illustrating how to hear the presentation in the game state, the occupied state, and the unoccupied state of the game machines 1 arranged in the game shop. FIG. 16A is a plan view illustrating an arrangement state of game machines arranged in a conventional game shop. FIG. 16B is a plan view illustrating how to hear the presentation in the game state and a standby state of the game machines arranged in the conventional game shop.

As illustrated in FIGS. 16A and 16B, conventionally, only the currently playing state and the non-playing state can be determined. As a result, conventionally, as illustrated in the third game machine from the left side in FIG. 16B, the attraction presentation is performed even in the game machine in which the player interrupts the game. Conventionally, the attraction presentations are performed in the three game machines on the right side in FIG. 16B. As a result, the attraction presentations for the game machines overlap each other, and the non-playing visitor hardly recognizes which one of the game machines performs the attraction presentation for the non-playing visitor.

On the other hand, in the embodiment, the game state, the occupied state, and the unoccupied state can be determined as illustrated in FIGS. 15A and 15B. The presentation can be performed using at least one of the directional speaker 14 and the vibration speaker 17 provided in the operation switch unit 10.

For example, as illustrated in the second game machine 1 from the left in FIG. 15B, in the unoccupied state, the presentation sound can be emitted using the directional speaker 14 attached to the operation switch unit 10. Consequently, the presentation sound is heard only when the non-playing visitor passes in front of the game machine 1.

As illustrated in the fourth game machine 1 from the left in FIG. 15B, in the unoccupied state, for example, the presentation sound can be emitted using the vibration speaker 17 attached to the operation switch unit 10. Consequently, because the fourth game machine 1 from the left in FIG. 15B is located at an end of the game machine arrangement, the game machine 1 uses the vibration speaker 17 to radiates the sound in a wide range, and the attraction presentation effect of the game machine 1 is enhanced.

As illustrated in the third game machine 1 from the left in FIG. 15B, in the occupied state, the presentation sound can be emitted using the vibration speaker 17. Consequently, the presentation for encouraging only the player who interrupts the game to play the game can be performed by emitting the small sound using the vibration speaker 17. In this case, the presentation for encouraging only the player who interrupts the game to play the game can be also performed using the directional speaker 14.

As a result, the following effects can be expected using the directional speaker 14 and the vibration speaker 17.

That is, in the occupied state, the directional speaker 14 can radiate the sound as limited as possible to the area of the player who interrupts the game. In the unoccupied state, the overlapping of the sounds of the game machines 1 is avoided, and the attraction presentation can efficiently be performed on the non-playing visitors passing in front of the game machine 1.

In the occupied state, the vibration speaker 17 emits the sound from the operation switch unit 10, which allows performing the presentation for encouraging a person who interrupts the game to play the game. In the unoccupied state, because the sound is radiated from the operation switch unit 10, the game machine 1 that radiates the sound can be easily recognized, and the attraction presentation can efficiently be performed on the non-playing visitors.

As described above, the game machine 1 of the embodiment has the credit function. The game machine 1 includes the credit function 3*b* as the credit determination part configured to determine the presence or absence of the credit and the timer part 3*a* configured to measure the lapse of time, and transitions to the occupied state in which the game is determined to be interrupted or the unoccupied state in which the game machine 1 is determined to be idle according to the determination of the presence or absence of the credit in the credit function 3*b* when the timer part 3*a* measures the lapse of the first time T1.

As a result, the game machine 1, which can discriminate between the two states of the occupied state and the unoccupied state by determining the presence or absence of the credit when the timer part 3*a* measures the lapse of the first time T1, can be provided.

The game machine 1 of the embodiment is provided with the controller 19 and the game machine-side controller 3, which control the game machine 1 to perform the attraction presentation on the non-playing visitors when transitioning to the unoccupied state.

Consequently, the game machine 1 is idle in the unoccupied state, so that the attraction presentation for encouraging the non-playing visitor to play the game using the game machine 1 can be performed. Paradoxically, the attraction presentation cannot be performed in the occupied state, namely, when the game is currently interrupted. Consequently, another person can be prevented from erroneously playing the game machine 1 in which the game is currently interrupted.

In the game machine 1 of the embodiment, when the occupation/non-occupancy determination part 19*b* determines the occupied state, the controller 19 and the game machine-side controller 3 perform the control such that the presentation for encouraging the player to play the game is performed.

That is, the occupied state means the state in which the player interrupts the game. Consequently, an operation rate of the game machine 1 can be enhanced by performing the presentation for encouraging the player to play the game.

The directional speaker 14 that emits the presentation sound is provided in the game machine 1 of the embodiment. The directional speaker 14 can emit the sound having the directivity. As a result, in the occupied state, the presentation sound for encouraging the game can be emitted as limited as possible to an area of the player who currently interrupts the game using the directional speaker 14. In the unoccupied state, the overlapping of the sounds of the game machines 1 is avoided, and the attraction presentation can efficiently be performed on the non-playing visitors passing in front of the game machine 1.

The vibration speaker 17 that emits the presentation sound is provided in the game machine 1 of the embodiment. For example, the vibration speaker 17 radially emits the contact sound of the lower attaching base 12 that is a metal plate from the operation switch unit 10. As a result, the sound is emitted from the operation switch unit 10 in the occupied state using the vibration speaker 17, so that the presentation for encouraging the player who interrupts the game to play the game can be performed. In the unoccupied state, because the sound is radiated from the operation switch unit 10, the game machine 1 that radiates the sound can be easily recognized, and the attraction presentation can efficiently be performed on the non-playing visitors.

The present invention is not limited to the above embodiment, and various modifications can be made within the scope of the present invention. For example, in the above embodiment, the game machine 1 makes the notification for encouraging the game in the occupied state. However, the present invention is not limited to this. For example, a public address system can notify the player who is away from the seat to return to the seat to continue the game.

The present invention is not limited to the above embodiment, various changes can be made without departing from the scope of the claims, and an embodiment acquired by a combination of technical means disclosed in different embodiments is also included in the technical scope of the present invention. Additionally, a new technical feature can be made by a combination of technical means disclosed in different embodiments.

The invention claimed is:

1. A game machine having a credit function, the game machine comprising:

a credit determination part configured to determine presence or absence of a credit;

a timer configured to measure a lapse of time;

a state determination part configured to (i) determine that the game machine is in a game state in which a player currently plays a game and in which, in a case where the credit determination part determines that a credit is present, a period from an end of a game start of a next game is shorter than a first time (ii) determine that the game machine is in a first state in which the game machine is occupied but a game is interrupted, in a case where, upon a lapse of the first time as measured by the timer, the credit determination part determines that a credit is present, and (iii) determine that the game machine is in an unoccupied state in which the game machine is idle, in a case where, upon a lapse of the first time as measured by the timer, the credit determination part determines that a credit is absent;

a notification part configured to perform a presentation, in accordance with a result of determination by the state determination part, on the player who plays the game and on a non-playing visitor who does not play the game; and a controller configured to control the notification part, wherein the notification part includes a vibration speaker and a directional speaker each of which is configured to emit sound of the presentation, in a case where the state determination part determines that the game machine is in the game state, the controller causes the notification part to perform, on the player, a presentation for the player, in a case where the state determination part determines that the game machine transitions from the game state to the first state, the controller causes the notification part to perform a presentation for encouraging the player to start the game, in a case where the state determination part determines that the game machine transitions from the game state to the unoccupied state, the controller causes the notification part to perform an attraction presentation on the non-playing visitor, in a case of the first state, performance by the notification part is emission of sound of the presentation by use of the vibration speaker, and in a case of the unoccupied state, performance by the notification part is emission of sound of the presentation by use of the directional speaker.

* * * * *